United States Patent [19]

Ikäheimo

[11] Patent Number: 4,693,467

[45] Date of Patent: Sep. 15, 1987

[54] SPRING STRUCTURE INTENDED SPECIFICALLY FOR PLAY OR EXERCISE APPARATUS

[75] Inventor: Antero Ikäheimo, Rovaniemi, Finland

[73] Assignee: Pohjoiskalotti Oy, Rovaniemi, Finland

[21] Appl. No.: 777,693

[22] PCT Filed: Jan. 7, 1985

[86] PCT No.: PCT/FI85/00004

§ 371 Date: Sep. 3, 1985

§ 102(e) Date: Sep. 3, 1985

[87] PCT Pub. No.: WO85/03010

PCT Pub. Date: Jul. 18, 1985

[30] Foreign Application Priority Data

Jan. 9, 1984 [FI] Finland ..... 840075

[51] Int. Cl.[4] ..... A63G 17/00

[52] U.S. Cl. ..... 272/52; 272/135; 272/54

[58] Field of Search ..... 272/52, 52.5, 53.1, 272/53.2, 54, 55, 56, 50, 51, 65, 66, 110, 135, 136, 137, 138, 114; 267/59, 62, 156; 297/196, 181

[56] References Cited

U.S. PATENT DOCUMENTS

| | | | |
|---|---|---|---|
| 1,287 | 3/1862 | Crandall | 272/52 |
| 64,432 | 5/1867 | Limerick | 272/55 |
| 143,930 | 10/1873 | Reinhart | 272/52 |
| 150,825 | 5/1874 | Caldwell | 272/53.2 X |
| 1,624,986 | 4/1927 | Sherrod | 272/52 |
| 1,729,214 | 9/1929 | Gordon | 272/52 X |
| 1,771,920 | 7/1930 | Gordon | 297/196 X |
| 2,173,300 | 9/1939 | Heldman | 272/52 X |
| 2,718,398 | 9/1955 | Barkschat | 272/137 X |
| 2,769,484 | 11/1956 | Kairath | 272/52 |

FOREIGN PATENT DOCUMENTS

| | | | |
|---|---|---|---|
| 149 | of 1861 | United Kingdom | 272/52 |
| 10405 | of 1888 | United Kingdom | 272/52 |
| 419515 | 11/1934 | United Kingdom | 272/55 |

*Primary Examiner*—Robert A. Hafer
*Assistant Examiner*—Danton DeMille
*Attorney, Agent, or Firm*—Birch, Stewart, Kolasch & Birch

[57] ABSTRACT

A spring structure, which is intended specifically for play or conditioning exercise apparatus, comprises on the one hand a helical spring (1) made from flat steel or similar material, the spring having about 1.5–2 turns, and on the other hand a brace (2) fastened to the inner end (1*a*) of the spring, the brace being U-shaped in the middle in such a way that its arms extend to both sides of the helical spring (1), leaving the spring free, and is in other respects shaped in such a way that the structure can be fastened by the brace to a base such as the floor or the ceiling. To the free end (1*b*) of the spring it is possible alternatively to fasten different apparatus, for example, a rocking horse (4), a seesaw, an exercise bar, etc.

5 Claims, 3 Drawing Figures

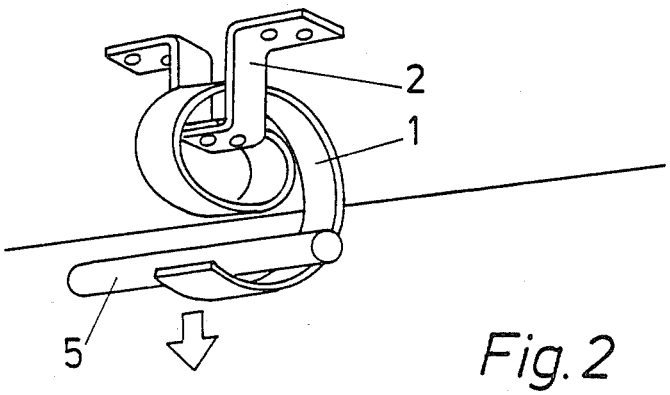
Fig. 2
Fig. 3
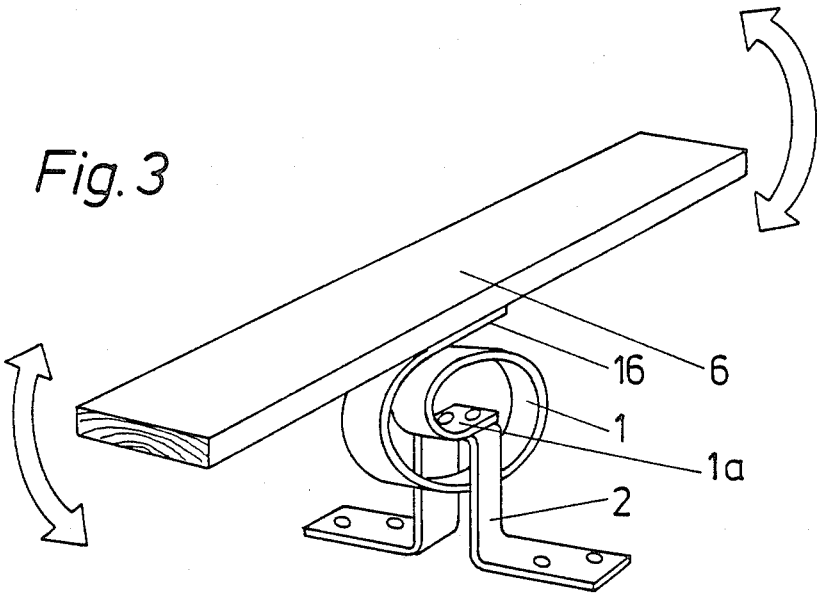

SPRING STRUCTURE INTENDED SPECIFICALLY FOR PLAY OR EXERCISE APPARATUS

BACKGROUND OF THE INVENTION

1. Field of the Invention

The present invention relates to a spring structure intended specifically for play or exercise apparatus.

2. Description of Background Art

It is well known, even usual, to use various springs in play apparatus, for example in order to produce rocking movements. Also in exercise apparatus, springs of different resilience are used for conditioning exercises. However, it can be noted as a general feature that different spring structures have been created for each different apparatus, in which case, owing to the small production series, the structures are usually rather expensive.

SUMMARY AND OBJECTS OF THE INVENTION

The object of the present invention is therefore to provide a spring structure which, on the one hand, is very simple and inexpensive to manufacture and, on the other hand, can be used for numerous applications, both for play apparatus and for exercise apparatus and park benches. In order to provide such a versatile spring structure the invention is characterized in that which is presented in the accompanying independent claim. Certain preferred embodiments are defined in the dependent claims.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is described below in greater detail in the form of examples and with reference to the accompanying drawings, in which each diagram depicts a perspective view of one application of the spring structure.

FIG. 2 is a perspective view of the spring structure attached to a ceiling with an exercise bar fastened thereto; and FIG. 3 is a perspective view of the spring structure affixed to a seesaw.

Figure 1:
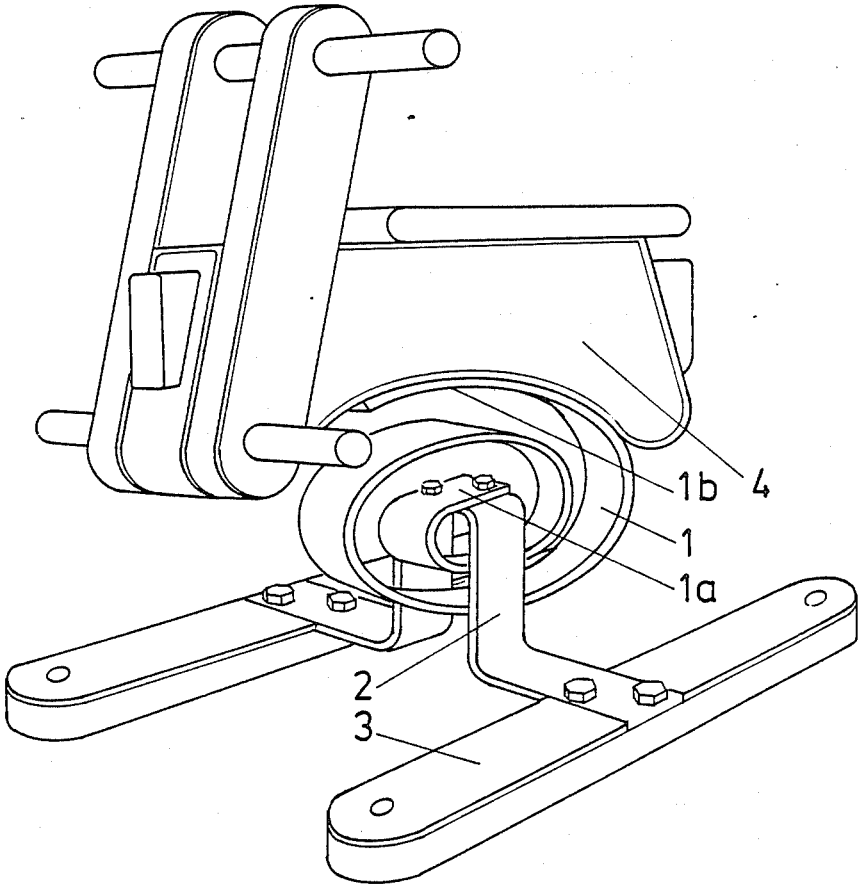
FIG. 1 is a perspective view of the spring structure used together with a toy.

Referring now to the diagrams, the essential part of the spring structure consists of a helical spring 1 made from flat steel; it may have a somewhat oval overall shape, as shown in the figures. The thickness and the width of the spring are, of course, according to the intended use. The spring may comprise, for example, about 1.5 turns or 2 turns made in such a way that the ends of the spring are along approximately parallel planes.

At the inner end 1*a* of the spring 1 there is attached a brace 2 which is U-shaped in the middle and which may also be of similar flat steel. The brace 2 is somewhat wider than the width of the spring 1, so that its arms extend freely to both sides of the spring 1. Likewise, the U-shaped part of the brace 2 is deeper than the radial dimension of the spring, so that the brace can support the spring freely. The ends of the brace are bent outwards, preferably along the same plane, in which case the brace can be easily and sturdily secured to a base, for example by means of bolts.

The figures show different practical applications of the spring structure. FIG. 1 shows a sketch of a rocking horse 4, the lower part of which is fastened to the outer end 1*b* of the spring 1. Sturdiness is increased by the lower part of the horse having a shape corresponding to that of the end 1*b* of the spring. The ends of the brace 2 are fastened to two runners 3, which can be further fastened to the floor, if necessary.

FIG. 2 depicts an exercise bar 5, which is fastened to the free end of the spring 1. The brace 2 is preferably fastened to the ceiling by means of bolts. It is clear that this structure can also be fastened to the floor, for example, for pulling exercises.

FIG. 3 shows a seesaw 6, which is fastened to the end 16 of the spring 1. The brace 2 is fastened to a base, for example the floor or the ground.

It is clear that numerous further applications are possible within the scope of the invention. In fact, providing such possibilities is specifically one object of the invention, as was mentioned above.

I claim:

1. A spring structure intended particularly for a play and exercise apparatus, comprising:

a helical spring member made of flat steel material with sides, a predetermined width and turns, said helical spring member having an inner end and an outer end, said outer end being adapted for attachment to a movable member;

a brace member also made of flat steel material and having an essentially U-shaped middle portion, said U-shaped middle portion including arm portions and a substantially horizontal web portion centrally disposed within said U-shaped middle portion and having a predetermined length;

said inner end of said helical spring member being secured to and across said web portion wherein the predetermined length of the web portion is greater than the predetermined width of said helical spring member;

said arm portions of the brace member extending along the sides of the helical spring in a general direction away from said outer end and beyond an outermost turn of the spring member;

a fastening base, said fastening base being substantially horizontally positioned and said inner and outer ends of said helical spring being substantially horizontal with said inner end being affixed to said web portion and said outer end being disposed adjacent to said inner end and spaced apart by turns of said helical spring with said outer end being affixed to said movable member; and outer ends of said arm portions being bent outwardly in a substantially horizontal position, said outer ends lie essentially in the same plane, said outer ends are fastened to said fastening base for supporting the spring structure.

2. A spring structure according to claim 1, wherein said movable member is a rocking horse.

3. A spring structure according to claim 1, wherein said movable member is a seesaw.

4. A spring structure according to claim 1, wherein said movable member is an exercise bar.

5. A spring structure according to claim 1, wherein the flat spring comprises about 1.5 turns and that its two ends are substantially parallel.

* * * * *